US011674343B2

(12) United States Patent
Notohardjono et al.

(10) Patent No.: US 11,674,343 B2
(45) Date of Patent: Jun. 13, 2023

(54) MULTI-AXIAL DOOR CATCH

(71) Applicant: INTERNATIONAL BUSINESS MACHINES CORPORATION, Armonk, NY (US)

(72) Inventors: Budy Notohardjono, Poughkeepsie, NY (US); Richard M. Ecker, Poughkeepsie, NY (US); Suraush Khambati, Poughkeepsie, NY (US); Shawn Canfield, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 111 days.

(21) Appl. No.: 17/352,188

(22) Filed: Jun. 18, 2021

(65) Prior Publication Data

US 2022/0403687 A1 Dec. 22, 2022

(51) Int. Cl.

| | |
|---|---|
| ***E05C 5/04*** | (2006.01) |
| ***E05C 3/04*** | (2006.01) |
| ***E05C 5/00*** | (2006.01) |

(52) U.S. Cl.

CPC ..... *E05C 5/04* (2013.01); *E05C 3/042* (2013.01); *E05C 2005/005* (2013.01)

(58) Field of Classification Search

CPC ..... Y10T 292/0887; Y10T 292/68; Y10T 292/696; Y10T 292/702; Y10T 292/705;

(Continued)

(56) References Cited

U.S. PATENT DOCUMENTS 476,159 A * 5/1892 Muller ..... E05B 63/244 292/341.15
577,818 A * 2/1897 Cronk ..... E05B 15/0093 292/136

(Continued)

FOREIGN PATENT DOCUMENTS

EP 0178610 A2 * 10/1985 ..... E05B 15/022
FR 2616474 A1 * 6/1987 ..... F16B 5/025

(Continued)

OTHER PUBLICATIONS

Murakoshi Mfg. Corp., Earthquake-proof latch series product information, ver. 1.0/2017.5 (estimated publication date 2017).

*Primary Examiner* — Kristina R Fulton
*Assistant Examiner* — Steven A Tullia
(74) *Attorney, Agent, or Firm* — Tihon Poltavets

(57) ABSTRACT

A multi-axial catch comprises a mount and a catch body coupled to the mount. The mount affixes the catch to a frame and the catch body has a recess to position a latch head of a latch within the recess to engage the latch with the catch. The catch can include a cam to form the recess. The catch rotates around a rotation axis in response to a longitudinal motion of the latch. The catch body is coupled to the mount to allow the catch body to rotate around a pivot axis in response to a transverse motion of the latch. The catch includes an elastic coupler to position the catch in a rotational at-rest position and an elastic coupler to position the catch-body in a transverse at-rest position. The recess allows the latch head to move laterally, in response to a lateral motion of the latch, within the catch.

12 Claims, 6 Drawing Sheets

(58) Field of Classification Search
CPC ..... Y10T 292/1043; Y10T 292/1051; E05C 5/04; E05C 3/042; E05C 2005/005; E05C 9/1808; Y10S 292/29; E05B 15/021; E05B 15/022; E05B 15/024; E05B 63/244; E05B 2015/0265; E05B 2015/027
See application file for complete search history.

(56) References Cited

U.S. PATENT DOCUMENTS 705,147 A * 7/1902 Rischmuller ..... E05B 63/244 292/DIG. 72
723,843 A * 3/1903 Dimock ..... E05B 85/24 292/229
984,118 A * 2/1911 Wilcox ..... E05C 19/063 292/DIG. 19
1,061,878 A * 5/1913 Smith ..... E05C 3/12 292/254
1,239,393 A * 9/1917 Hotchkiss ..... E05B 65/0811 292/DIG. 19
1,469,659 A * 10/1923 McGuire ..... E05F 11/00 292/87
1,660,598 A * 2/1928 Crane ..... E02F 3/4075 292/145
1,662,119 A * 3/1928 Lewis ..... E05C 3/30 292/340
2,186,747 A * 1/1940 Albin ..... F16B 5/10 411/347
2,223,765 A * 12/1940 Komenak ..... E05C 1/16 292/169.21
2,287,710 A * 6/1942 Sayles ..... E05C 3/12 292/341.17
2,542,876 A * 2/1951 Main ..... G07D 9/06 232/7
2,626,170 A * 1/1953 Nottingham ..... E05C 19/02 292/78
2,641,493 A * 6/1953 Flugrath ..... E05C 19/06 292/19
2,669,473 A * 2/1954 Trumbo ..... E05B 65/0007 292/45
2,693,043 A * 11/1954 Leake ..... E05F 1/04 49/237
2,699,568 A * 1/1955 Herscher ..... E05B 65/46 312/334.47
2,703,730 A * 3/1955 Holver ..... E05C 19/024 292/340
2,706,316 A * 4/1955 Jones ..... F25D 23/063 292/341.15
2,793,891 A * 5/1957 Frye ..... E05C 17/52 292/18
2,811,380 A * 10/1957 Osner ..... E05B 13/002 292/108
2,825,594 A * 3/1958 Hatchette, Sr. ..... E05C 19/10 292/340
2,912,272 A * 11/1959 Wade ..... E05B 83/24 292/DIG. 14
2,926,945 A * 3/1960 Clark ..... E05B 65/0042 292/99
3,912,311 A * 10/1975 Carvell ..... E05B 65/0835 292/216
3,918,752 A * 11/1975 Leone ..... E05B 65/0014 292/277
4,022,504 A * 5/1977 Anderson ..... E05C 19/06 292/76
4,076,294 A * 2/1978 Holmberg ..... E05B 15/022 292/341.17
4,099,754 A * 7/1978 Hoebing ..... E05C 5/04 292/206
4,115,845 A * 9/1978 Blahut ..... F21V 21/38 362/403
4,765,662 A * 8/1988 Suska ..... E05B 65/06 292/254
4,844,520 A * 7/1989 Muller, Jr. ..... E05B 15/022 292/341.17
5,152,562 A * 10/1992 Stevenson ..... E05B 15/0093 292/DIG. 22
5,312,143 A 5/1994 Buckner
5,409,271 A * 4/1995 Hoffmann ..... E05B 63/0004 292/DIG. 47
5,593,192 A 1/1997 Stuchinsky
5,597,188 A 1/1997 Miché
6,425,488 B1 7/2002 Notohardjono
6,607,224 B2 * 8/2003 Hodges ..... E05B 15/022 292/303
6,866,309 B1 * 3/2005 Marks ..... E05C 17/24 292/DIG. 53
7,021,678 B1 * 4/2006 Raoult ..... A01K 1/0017 292/341.15
7,425,026 B1 9/2008 Henderson et al.
7,874,433 B2 1/2011 Levesque
8,177,267 B2 5/2012 Kuehn
8,960,815 B2 2/2015 Karandikar et al.
9,487,978 B2 11/2016 Aono
2002/0008391 A1 1/2002 Patton
2004/0145193 A1 * 7/2004 Walcome ..... E05C 17/50 292/340
2010/0090480 A1 * 4/2010 Pyun ..... E05B 81/22 292/341.15
2015/0184436 A1 * 7/2015 Caruso ..... E05C 19/005 292/338
2017/0335599 A1 11/2017 Casternovia

FOREIGN PATENT DOCUMENTS

FR 2833212 A1 * 6/2003 ..... B60J 1/16
GB 296891 A * 9/1928 ..... E05C 5/04
JP 2000325167 A * 11/2000
JP 2005213955 A * 8/2005
JP 2006028780 A * 2/2006
JP 2006028781 A * 2/2006
JP 2006194078 A * 7/2006
JP 2013204250 A * 10/2013
JP 2014173276 A * 9/2014
JP 6163051 B2 * 7/2017
WO WO-2006060740 A2 * 6/2006 ..... E05B 15/022
WO 2009118958 A1 10/2009

* cited by examiner

MULTI-AXIAL DOOR CATCH

BACKGROUND

The present disclosure relates to latches for doors, and more specifically, to a catch to secure closure of the door during motions of the door.

SUMMARY

According to the present disclosure (hereinafter, "the disclosure"), a multi-axial catch can secure a door in a closed position during various spatial motions of the door. In embodiments of the disclosure (hereinafter, "embodiments"), such a multi-axial catch comprises a mount and a catch body coupled to the mount. The mount is configured to affix the catch to a frame and the catch body has a recess to position a latch head of a latch of a door to engage the latch with the catch. The mount is further configured to allow the catch to rotate around a rotation axis in response to a longitudinal motion of the latch. Rotation of the catch around the rotation axis, combined with the latch head positioned within the recess, maintains the latch engaged with the catch during the longitudinal motion of the latch. The catch further comprises a rotational at-rest position of the catch, and an elastic coupler configured to position the catch in the rotational at-rest position.

In embodiments the catch body coupled is to the mount so as to allow the catch body to rotate, in response to a transverse motion of the latch, around a pivot axis. Rotation of the catch body around the pivot axis, combined with the latch head positioned within the recess, maintains the latch engaged with the catch during the transverse motion of the latch. The catch further comprises a transverse at-rest position of the catch body, and an elastic coupler configured to position the catch body in the transverse at-rest position.

In some embodiments, the catch body comprises a cam to form the recess. The cam has a geometry to permit the latch head to move, in response to a lateral motion of the latch, laterally within the recess. The cam acts to retain the latch head positioned within the recess during the lateral motion of the latch.

In one alternative embodiment, a multi-axial catch comprises a mount pin configured to affix the catch to a frame, The catch further comprises a recess to position a latch head of a latch to engage the latch of a door with the catch. The mount pin is further configured to allow the catch to rotate around a rotation axis in response to a longitudinal motion of the latch. Rotation of the catch around the rotation axis, combined with the latch head positioned within the recess, maintains the latch engaged with the catch during the longitudinal motion of the latch. The catch further comprises a rotational at-rest position of the catch, and an elastic coupler configured to position the catch in the rotational at-rest position. The catch body can comprise a cam to form the recess. The cam has a geometry to permit the latch head to move, in response to a lateral motion of the latch, laterally within the recess. The cam acts to retain the latch head positioned within the recess during the lateral motion of the latch.

In another alternative embodiment, a multi-axial catch comprises a mount and a catch body coupled to the mount. The mount is configured to affix the catch to a frame and the catch body has a recess to position a latch head of a latch of a door within the recess to engage the latch with the catch. The catch body coupled is to the mount so as to allow the catch body to rotate, in response to a transverse motion of the latch, around a pivot axis. Rotation of the catch body around the pivot axis, combined with the latch head positioned within the recess, maintains the latch engaged with the catch during the transverse motion of the latch. The catch further comprises a transverse at-rest position of the catch body, and an elastic coupler configured to position the catch body in the transverse at-rest position. The catch body can comprise a cam to form the recess. The cam has a geometry to permit the latch head to move, in response to a lateral motion of the latch, laterally within the recess. The cam acts to retain the latch head positioned within the recess during the lateral motion of the latch.

The above summary is not intended to describe each illustrated embodiment or every implementation of the present disclosure.

BRIEF DESCRIPTION OF THE DRAWINGS

The drawings included in the present disclosure are incorporated into, and form part of, the specification. They illustrate embodiments of the present disclosure (hereinafter, "the disclosure") and, along with the description, serve to explain the principles of the disclosure. The drawings are only illustrative of certain embodiments and do not limit the disclosure.

Figure 1A:
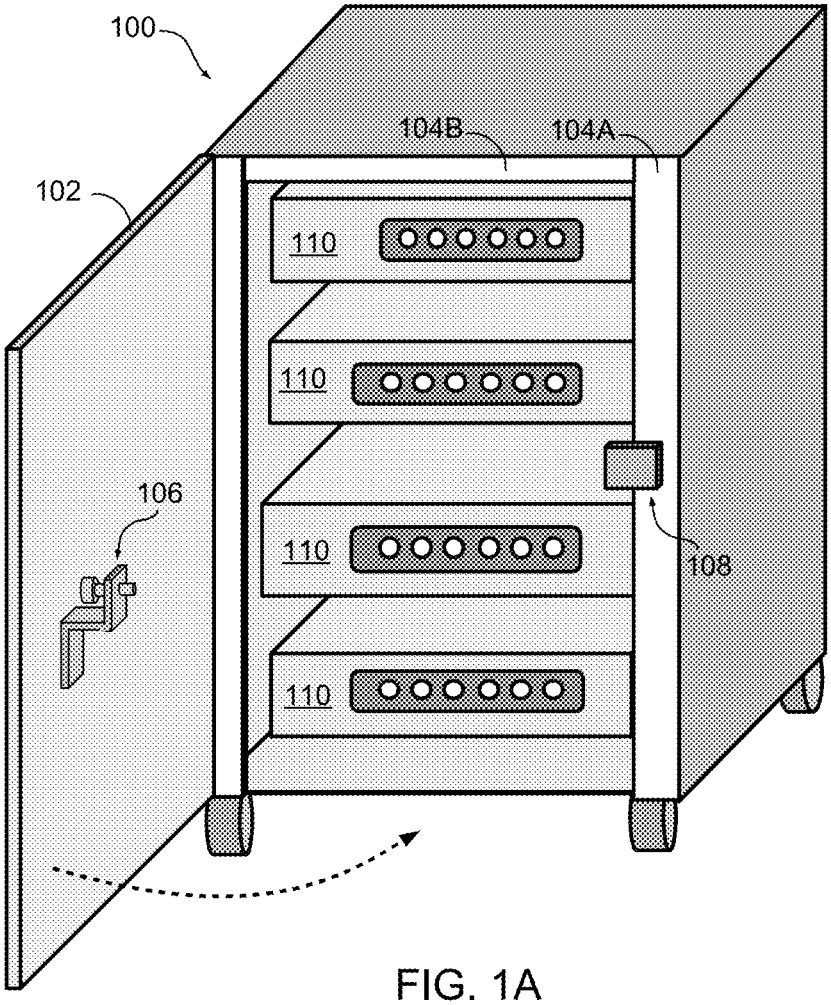
FIG. 1A illustrates an example cabinet having a door, latch, and catch according to aspects of the disclosure.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the disclosure.

DETAILED DESCRIPTION

Aspects of the present disclosure (hereinafter, "the disclosure") relate to a "multi-axial catch" to secure closure of a door. More particular aspects relate to such a catch configured to maintain the door in the closed position during motions of the door along various spatial axes. While the disclosure is not necessarily limited to such applications, various aspects of the disclosure may be appreciated through a discussion of various examples using this context.

Various structures use doors to close an interior space of the structure. Doors of a building can close rooms of a building; a cabinet can utilize a door to close the cabinet when interior access to the cabinet is not required. For example, a computing system can use a cabinet to house components (e.g., compute, storage, and/or network components) of the system. The cabinet can be enclosed by a door that can permit access to the internal components when open, but can then be closed to secure the components within the cabinet.

In another example, a computing system can comprise a frame and "drawers" that are mounted within the frame, and the drawers can contain components of the system. Such a system can include, for example, a drawer containing computing elements, a drawer containing storage elements, a drawer containing networking components, and/or a drawer containing power components. The frame and drawers of the computing system can be housed within a cabinet and a door of the cabinet can enclose the computing system within the cabinet. Alternatively, a computing system can mount drawers to the frame of a "rack", without a cabinet or door to enclose it. In such a system a panel (or, a frame) of a drawer (e.g., a front or rear panel of a drawer) can operate like a door to secure the drawer internally within the rack.

For simplicity of the disclosure, the examples of the disclosure are directed to securing closure of a door of a cabinet, such as a cabinet housing computing, electrical, and/or mechanical equipment; or, a cabinet housing materials, such as liquids, metal plates or components, and/or hazardous materials. However, the examples of the disclosure are not intended to limit embodiments, and it would be apparent to one of ordinary skill in the art that principles and aspects of the disclosure can apply equally to alternative applications. For example, a drawer of a desk or cabinet can, similarly, require secure closure and, a panel or frame of the drawer (e.g., a front or rear panel of a drawer) can operate like a door to secure the drawer in a closed position within the desk or cabinet. Thus, it would be evident to one of ordinary skill in the art to apply embodiments of the disclosure to securing closure of a drawer of a desk or cabinet, or other applications requiring securing one structure within or to another, in addition or alternative to securing closure of a door per se and as illustrated by the examples of the disclosure.

To secure a door (or, for example, a drawer) in a closed position, a door can commonly include a "latch" and a cabinet (or, a frame of a rack or a desk, for example) can include a "catch" that can engage the latch to secure closure of the door. As used herein, the term "latch" refers to a latch integrated with, or otherwise coupled to a door, and "catch" refers to a catch, mounted on a frame of a structure (e.g., a cabinet, rack, or doorway), to engage the latch to secure the door in a closed position. As further used herein, "frame" refers to any type or configuration of a frame of a structure on which a catch can be affixed, or mounted, to engage a latch of a door (or, for example, a drawer), such as a frame of a doorway, a frame of a cabinet, a frame of desk, as well as any segment (e.g., a horizontal or vertical segment) of such a frame.

Using a computing system cabinet as an example, a door of the cabinet can include a latch, and a catch can be affixed to a frame of the cabinet to engage the latch when the door is in a closed position. The catch engaged with the latch can secure the door in this closed position. In this example a catch can commonly comprise a "catch plate" mounted on a frame of a cabinet. A latch can be mounted on the door and can have a "latch head", such as a disk or spherical shaped portion of the latch (or, alternatively, an extension of the latch, such as a rod or pin) that can be positioned to be in contact with the catch plate to secure the door in a closed position. FIG. 1A illustrates an example of such a cabinet, and door of the cabinet, having a catch and latch, respectively, such as just described. In FIG. 1A, cabinet 100 comprises door 102, having latch 106 and frame segments 104A and 104B, which form intersecting segments of a frame of the cabinet (as shown in FIG. 1A, but not intended to limit embodiments, intersecting perpendicularly). Catch 108 is shown in FIG. 1A affixed to (e.g., "mounted" on) frame segment 104A, and in this position catch 108 can engage latch 106 to secure door 102 in a closed position enclosing the interior of cabinet 100.

For brevity, hereinafter the term "frame" refers to any segment of a frame to which a catch is mounted to engage a latch. Thus, with respect to FIG. 1A, "frame 104A" refers to vertical frame segment 104A of a frame of cabinet 100. Further, for a point of reference in FIG. 1A, the "top" of cabinet 100 can be considered to be at the upper extend of door 102 in FIG. 1A, and the "bottom" of cabinet 100 can be considered to be at the lower extent of door 102 in FIG. 1A. Thus, relative to cabinet 100 in this context, frame 104A can be considered to be a vertical frame segment of cabinet 100, and frame segment 104B can be considered to be a horizontal segment of cabinet 100.

For purposes only of illustrating the disclosure and to provide a frame of reference for the examples of the disclosure, but not intended to limit embodiments, as used herein, then, "vertical" refers to a direction from the top to the bottom (or, vice versa) of a cabinet and "horizontal" refers to a direction from one side to the other (e.g., from the left to the right side, or vice versa) of a cabinet. Similarly, as used herein, "interior" refers to space within a cabinet, "exterior" refers to space outside the cabinet, "inward" refers to a direction towards the interior of a cabinet, and "outward" refers to a direction away from the interior of a cabinet.

Thus, as shown in FIG. 1A, frame 104A can be a vertical segment of a frame of cabinet 100 and frame 104B can be a horizontal segment of the frame of cabinet 100. Correspondingly, a "vertical motion" of a door (such as 102) refers to a motion of the door in a direction towards the top or bottom of cabinet (such as 100) and a "horizontal motion" of a door refers to a motion in a direction towards one side or the other of a cabinet. An "inward" motion of a door (such as 102) refers to a motion of the door towards the interior of a cabinet (such as 100. And indicated in FIG. 1A by the broken arrow), and an "outward motion" of the door refers to a motion of the door away from the interior of the cabinet.

With catch plate 108 mounted on frame 104A as shown in FIG. 1A, in a closed position door 102 can engage latch 106 with catch plate 108 by positioning latch 106 (e.g., a latch head, or extension, of latch 106) against an interior face of catch plate 108. A catch plate, such as 108, can be a rigid plate (e.g., made of metal), which can be bolted or welded, for example, to a frame of a structure (such as frame 104A or, alternatively, frame 104B). The latch pressing against the rigid structure of the catch plate can serve to engage the catch and the latch to secure a door, such as 102, in a closed position of the door.

While not shown in FIG. 1A, latch 106 can be coupled to a handle of door 102 to, for example, pivot latch 106 downward (e.g., away from door 102), or rotate handle 106 (e.g., clockwise in the plane of door 102), to position latch 106 so as to not interfere with catch plate 108 when closing door 102. In a closed position, latch 106 can be positioned as shown in FIG. 1A (e.g., un-pivoted, or rotated back to vertical) such that latch 106 engages with catch plate 108, with door 102 closed, to secure door 102 in the closed position. FIG. 1A illustrates door 102 with latch 106 configured to engage catch plate 108 at vertical frame 104A. However, this is not intended to limit embodiments and it would be apparent to one of ordinary skill in the art that a catch plate, such as 108, can be alternatively mounted, for example, on a horizontal segment of a cabinet frame (e.g., 104B) and a door (e.g., 102) can have a latch (e.g., 106) configured to engage the catch plate at the horizontal segment of the frame (e.g., 104B).

Figure 1B:
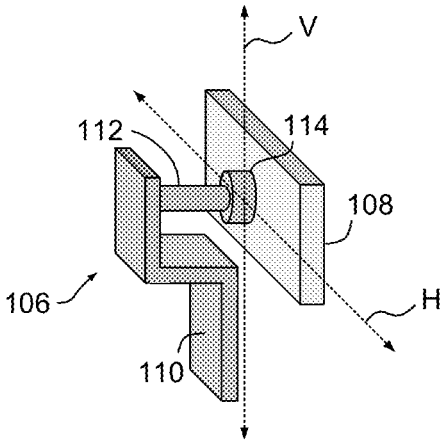
FIG. 1B illustrates an example latch and catch plate, according to aspects of the disclosure.

FIG. 1B depicts latch 106 and catch plate 108 in more detail, to further illustrate how catch plate 108 can engage latch 106 to secure door 102 in a closed position. In FIG. 1B, latch 106 is shown comprising latch pin 112 having latch head 114, at an end of latch pin 112 that can position latch head 114 to contact catch plate 108. As shown in FIG. 1B, latch 106 can engage catch plate 108 by pressing latch head 114 against the interior surface (the surface towards the interior of the cabinet) of catch plate 108, to secure a door, such as 102 in FIG. 1A, in a closed position. As previously described, latch 106 can pivot, or rotate, on a door to prevent interference between latch head 114 and catch plate 108 when closing or opening the door. Alternatively, as previously described, a latch can comprise, for example, a pin or rod (e.g., latch pin 112, omitting latch head 114) that can contact the catch with the door closed, and the end of the pin or rod that contacts the catch can serve as a "latch head" to engage the catch (e.g., latch pin 112 serving as an alternative to latch head 114 to contact and engage catch plate 108).

As previously described catch plate 108 can be a rigid plate fixed to a frame of cabinet 100. Latch 106 engaged with catch 108 can secure door 102 in its closed position against, for example, outward motions of door 102. For example, with latch 106 engaged with catch plate 108, latch head 114 pressed against the interior surface of catch plate 108 can oppose outward motions of door 102, to open the door. As can be further seen in FIG. 1B, in response to vertical and horizontal motions of door 102, with the door in its closed position, catch plate 108 can maintain engagement (e.g., contact) with latch 106 along vertical axis "V", and horizontal axis "H", respectively, according to the height (vertically) and length (horizontally) of catch plate 108.

As previously described, to close (or, open) a door, and to correspondingly engage (or, disengage) a catch plate with a latch, a latch can be fixed to a door using a handle that can position the latch, such as by pivoting or rotating the latch, to avoid interference with a catch plate while closing (or, opening) the door. To illustrate this, FIGS. 2A and 2B depict side views of a cabinet frame and a cabinet door with a pivoting latch, and FIGS. 2C and 2D illustrate top views of a cabinet frame and cabinet door with a rotating latch.

Figure 2A:
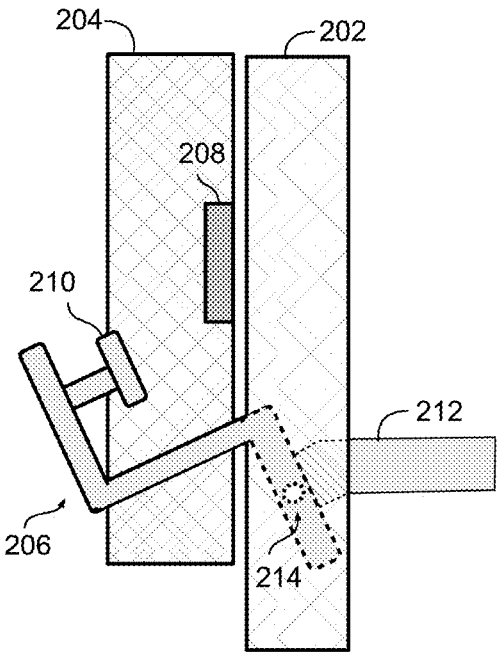
FIG. 2A illustrates an example pivoting latch in an open position, according to aspects of the disclosure.

FIG. 2A is a side view of door 202 and frame 204, which can be a door and a frame (e.g., a vertical segment of a frame), respectively, of a cabinet, such as cabinet 100 of FIG. 1A. Frame 204 includes catch plate 208 which, in FIG. 2A, can project outward from this side view of frame 204. Latch 206 includes, or can be coupled to, handle 212 and latch 206 can be coupled to door 202 by means of pivot pin 214 internal to door 202. Handle 212 can be raised upward or pressed downward to pivot latch 206, around pivot pin 214. For example, as shown in FIG. 1A, raising handle 212 upward can rotate latch 206 away from door 202 (toward the interior of the cabinet and away from an interior surface of door 202), such that door 202 can be opened or closed without latch 206 interfering with catch plate 208.

Figure 2B:
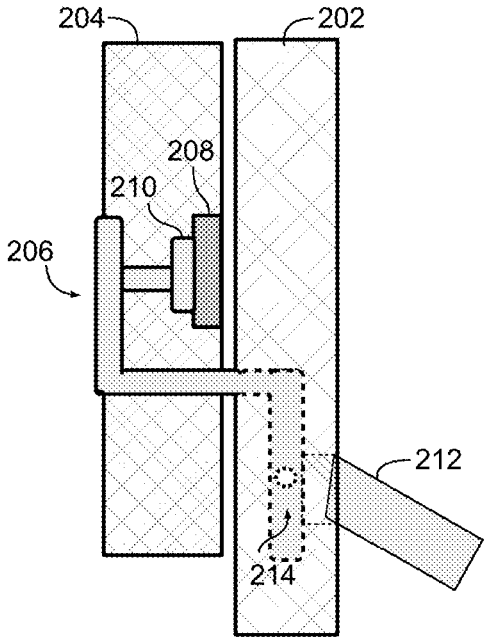
FIG. 2B illustrates an example pivoting latch in closed position, according to aspects of the disclosure.

FIG. 2B is a side view of door 202 and frame 204, of FIG. 2A, that illustrates door 202 in a closed position with latch 206 engaged with catch plate 208. As can be seen in FIG. 2B, pressing handle 212 downward can pivot catch 206 away from the cabinet interior and toward the interior surface of door 202, to press latch head 210, of latch 206, against catch plate 208. Positioning latch head 210 to press against catch plate 208 can engage latch 206 with catch plate 208 to secure closure of door 202 against outward motions of door 202.

Figure 2C:
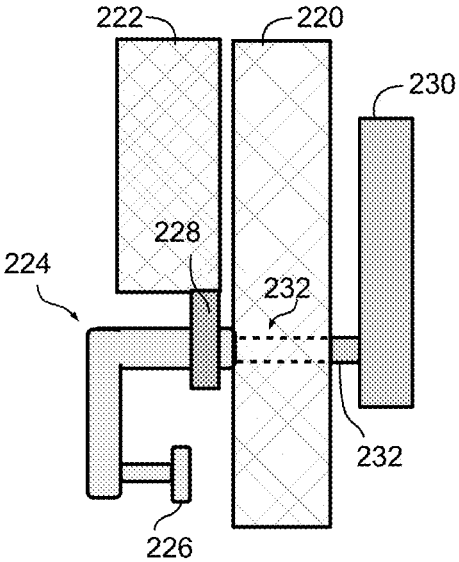
FIG. 2C illustrates an example rotating latch in an open position, according to aspects of the disclosure.
Figure 2D:
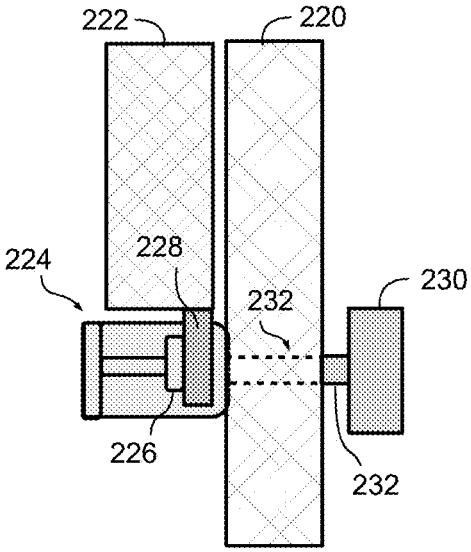
FIG. 2D illustrates an example rotating latch in a closed position, according to aspects of the disclosure.

FIG. 2C is a top view of door 220 and frame 222, which can be a door and a frame similar, respectively, to door 202 and frame 204 of FIGS. 2A and 2B. In FIG. 2C, frame 222 includes catch plate 228, and door 220 includes latch 224 coupled to handle 230. Latch 224 includes latch head 226, which, with door 220 closed, can be positioned by handle 230 to press latch head 226 against, and thereby engage with, catch plate 228 to secure door 220 in a closed position. FIG. 2C shows handle 230 coupled, internal to door 220, via link 232, to latch 224. Rotating handle 230 can in turn, via link 232, rotate latch 224. As can be seen in FIG. 2C, handle 230 rotated to a horizontal position can rotate link 232 and latch 224 to position latch head 226 away from catch plate 228, such that latch 224 and latch head 226 do not interfere with catch plate 228 when opening or closing door 220.

FIG. 2D is a top view of door 220 and frame 224, of FIG. 2C, that illustrates door 220 in a closed position with latch 224 engaged with catch plate 228. As can be seen in FIG. 2D, rotating handle 230 to a vertical position (e.g., rotating handle 230 clockwise to point downward) can rotate link 232 to orient latch 224 vertically to engage latch 224 with catch plate 228 by positioning latch head 226 against catch plate 228. Latch head 226 positioned in this way to contact (e.g., press against) catch plate 228 can secure door 220 in the closed position against outward motions of door 228.

The example latches and catch plates of FIGS. 1A, 1B, and 2A-2D can secure closure of a door of a cabinet, such as 102 in FIG. 1A, against outward motions of the door. Also, as previously described with reference to FIG. 1B, a latch head pressing against a catch plate can further maintain closure of the door in response to sideways (horizontal to the cabinet frame) and up or down (vertical to the cabinet frame) within the respective limits of the length and height of the catch plate surface that contacts the latch head.

However, in certain environments, a closed door of a cabinet can be subjected to strong forces that can produce motions of the door, and corresponding motions of a latch of the door, sufficient to disengage a latch from a catch (e.g., a catch plate). Such strong forces on a door can also produce corresponding forces on a latch, and/or a catch, sufficient to deform or damage the latch and/or catch. For example, a cabinet located in a geologically unstable environment can be subject to forces of an earthquake, and the forces can produce significant motions of the door inward/outward, up/down, and/or sideways. Such motions of the door can disengage a latch from a catch, such as a catch plate, allowing the door to open while subject to, or as a result of, such forces and corresponding motions. For example, a horizontal or vertical motion of a door can be sufficient to cause a latch head to disengage from (e.g., slip off of) a catch plate and allow the door to open. Similarly, such forces on the door and, correspondingly, on a latch and/or catch, a can mechanically distort, or deform, one or both of a latch and a catch plate such that the latch and/or the catch plate, door are damaged, rendered inoperable, and/or cannot secure the door in a closed position.

It can be a requirement, in fact, that the design of a catch can secure closure of a door (e.g., a door of an equipment or materials cabinet, or a doorway) during varying magnitudes and periods of earthquakes. Such a catch may be required to resist motions of the door along multiple spatial axes, without disengaging a latch of the door, and may be required to sustain forces of a latch of a door upon the catch, resulting from forces on the door and latch produced by an earthquake, without suffering deformation or damage of the door, latch, and/or catch. In some cases, a cabinet of a particular design must be tested to verify, and/or certify, that the design of the cabinet latching mechanism maintains the door in a closed position when subject to such forces. Should the door open during testing, the test can be deemed a failure. Similarly, should the test result in damage to, and/or deformation of, the latch and/or catch, the test can be deemed a failure and the cabinet can be rendered defective and require repair for sale or use, or must be disposed of.

Thus, it can be advantageous to provide a catch that can maintain engagement of a latch in response to motions and forces of a closed door along multiple axes, to secure closure of the door, and that can do so without damage to the catch, latch, and/or components of the door and/or cabinet resulting from such motions of the closed door. Accordingly, in embodiments, a "multi-axial catch" can allow a closed door to move along horizontal, vertical, and transverse (e.g., inward or outward) spatial axes without disengaging a latch of the door from the catch. Further, by allowing a door to move, at least partially, along these multiple axes, a multi-axial catch can relieve the forces of the door upon the latch and catch and thereby avoid, or limit, deformation of or damage to the latch and catch, as well as other components of a cabinet that may be damaged by forces on the door in the direction of these axes.

Figure 3A:
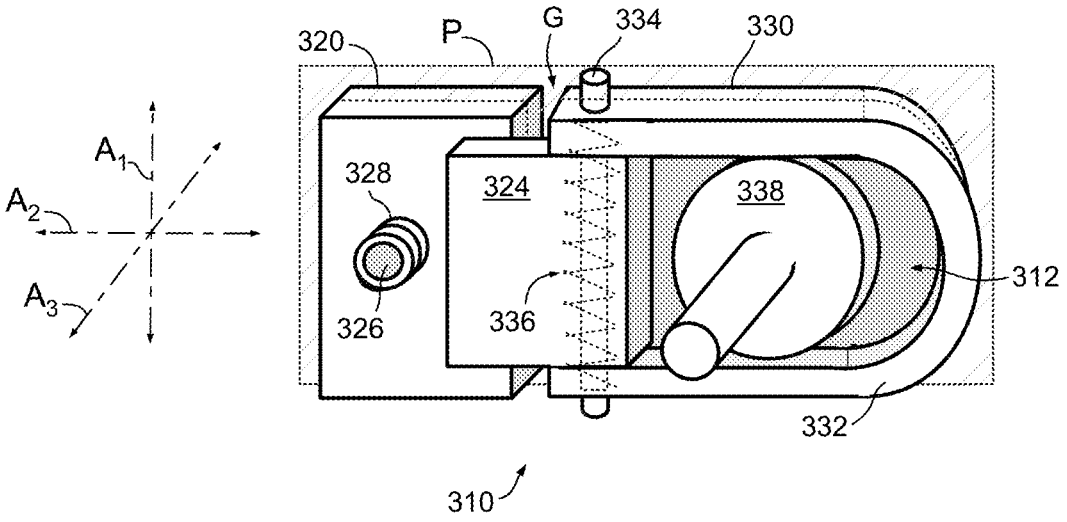
FIG. 3A illustrates a rear view (as viewed from the interior of a cabinet) of an example multi-axial catch, according to aspects of the disclosure.
Figure 3B:
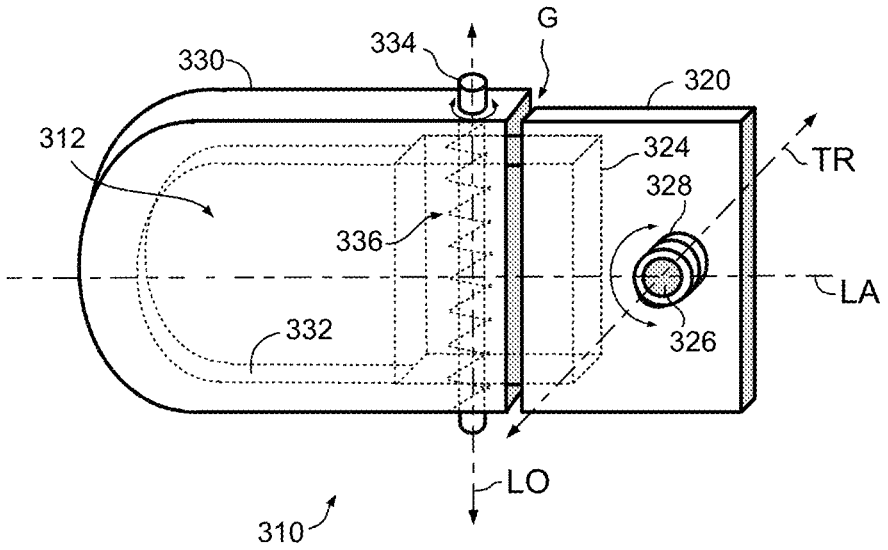
FIG. 3B illustrates a front view (as viewed from the exterior of a cabinet) of the example multi-axial catch of FIG. 3A, according to aspects of the disclosure.

In embodiments, a multi-axial catch can comprise a mount and a catch body, coupled to the mount. The mount and catch body can rotate, in combination, around a transverse axis of the mount, and/or can rotate around a longitudinal axis of the catch body. Further, such a multi-axial catch can include a recess that can engage a latch head within the recess to allow "in-plane" (within a vertical and horizontal plane of the catch body) motion of the latch head, within the recess, while maintaining engagement of the latch during such motion. FIGS. 3A and 3B depict an example embodiment of such a multi-axial catch. FIG. 3A is an isometric rear view (as viewed from inside a cabinet, for example) of example multi-axial catch 310 (hereinafter, "catch 310"), and FIG. 3B is an isometric front view (as viewed from outside a cabinet, for example) of catch 310.

For purposes of illustrating the examples of the disclosure, in FIG. 3A axes "$A_1$", "$A_2$", and "$A_3$", and plane P (passing vertically and horizontally through catch 310, relative to the orientation of catch 310 in FIG. 3A), provide a spatial frame of reference. As illustrated in FIG. 3A, axes A1, A2, and A3 can be mutually perpendicular. FIG. 3A further depicts plane P passing through catch 310 parallel vertically axis $A_1$ and parallel horizontally to axis $A_2$. As used herein "longitudinal" refers to a direction, lying within plane P, along axis $A_1$; "lateral", as used herein, refers to a direction, lying within plane P and perpendicular to axis $A_1$, along axis $A_2$; and, "transverse", as used herein, refers to a direction along axis A3, perpendicular to plane P and both of axes $A_1$ and $A_2$.

Thus, within this frame of reference, in FIG. 3A axis $A_1$ corresponds to a "longitudinal" axis of catch 310; axis $A_2$ corresponds to a "lateral" axis of catch 310; and, axis $A_3$ corresponds to a "transverse" axis of catch 310. To illustrate further, with reference again to cabinet 100 of FIG. 1A (as representative of a cabinet having a door and a catch affixed to a frame of the cabinet to securely close the door), "longitudinal" can refer to a direction parallel to the length a vertical segment of a cabinet frame; "lateral" can refer to a direction from left to right of the cabinet; and, "transverse" can refer to a direction inward and outward of the cabinet.

Correspondingly, as used herein a "longitudinal motion" refers, then, to a motion in the direction of a longitudinal axis, such as a motion of door 102, of cabinet 100 in FIG. 1A, upward and downward in the direction of axis $A_1$; a "lateral motion" refers to motion along a lateral axis, such as a sideways motion of door 102 in the direction of axis $A_2$; and, a "transverse motion" refers to motion along a transverse axis, such as inward or outward motion of door 102 in the direction of axis $A_3$. In the descriptions of the examples of FIGS. 3A, 3B, and FIGS. 4A-4F to follow, then, references to axes $A_1$, $A_2$, and $A_3$ will be understood in this context as referring, respectively, to longitudinal, lateral, and transverse axes; and, conversely, references to longitudinal, lateral, and transverse axes will be understood in this context as referring, respectively, to axes in the direction of axes $A_1$, $A_2$, and $A_3$ relative to a multi-axial catch, such as catch 310 in FIG. 3A.

Turning now to details of FIG. 3A, FIG. 3A illustrates example multi-axial catch 310 (hereinafter, "catch 310") comprising mount plate 320, link plate 324, and catch body 330. In embodiments mount plate 320 and link plate 324, in combination, can form a mount of catch 310 to affix catch 310 to, for example, a frame of a cabinet. A mount plate can affix a multi-axial catch to a frame using, for example, a mount pin. Thus, FIG. 3A depicts mount plate 320 comprising mount pin 326 which can affix catch 310 to a frame of a cabinet. Mount pin 326 can be, for example, a screw or a bolt that can affix mount plate 320 to a frame.

In embodiments, a multi-axial catch can rotate, as a whole (e.g., catch 310 as a combination of mount 320 coupled to catch body 330), around a "rotation axis". As used herein, "rotation axis" refers to an axis around which a catch can rotate in response to longitudinal forces on the catch (e.g., forces resulting from longitudinal motions of a door relative to a frame on which the catch is affixed). Thus, in FIG. 3A, axis $A_3$ passing through mount pin 326 can comprise such a rotation axis and mount pin 326 can facilitate rotation of a multi-axial catch around this axis. As will be seen in discussion of FIGS. 4C and 4D, rotation of a multi-axial catch around a rotation axis (e.g., a rotation axis of the mount) can facilitate the catch maintaining closure of a door in response to longitudinal motions of the door.

However, the example of FIG. 3A is not intended to limit embodiments. As just described, affixing the catch to the frame is advantageously achieved with any mechanical mount mechanism that can enable a multi-axial catch to rotate around a rotation axis. It will be apparent to one of ordinary skill in the art that a variety of mechanical structures and/or fasteners can serve to mount a multi-axial catch to a frame. For example, mount plate 320, in FIG. 3A, need not be a flat plate, nor necessary have a rectangular shape such as shown in FIG. 3A. In an alternative embodiment, mount plate 320 can, for example, be a cylinder or have a cylindrical (or, a disk) shape, with mount pin 326 passing through the center of the cylinder (or, disk). By means of the cylindrical mount rotating around mount pin 326, catch 310, as a whole, can rotate around a rotation axis passing through the center of the cylinder. Similarly, a mount need not be fastened to a frame using a pin; rather, a variety of mechanical fasteners, alternative to a mount pin such as 326, can serve to affix a multi-axial catch (e.g., a mount plate of a catch) to a frame in a manner that can facilitate rotation of the catch around a rotation (i.e., transverse) axis of the mount mechanism.

FIG. 3A further illustrates link plate 324 coupling mount plate 320 to catch body 330 by means of pivot pin 334 passing through (indicated by hidden lines of pivot pin 334) catch body 330 and link plate 324. In embodiments catch body 330 can rotate around a longitudinal axis of the catch, such as around a longitudinal axis passing through pivot pin 334. As used herein, "pivot axis" refers to any longitudinal axis around which a catch body can rotate in response to a transverse force on the catch body (e.g., in response to forces on a latch head and catch body produced by motions of a door inward or outward relative to a cabinet).

Figure 4A:
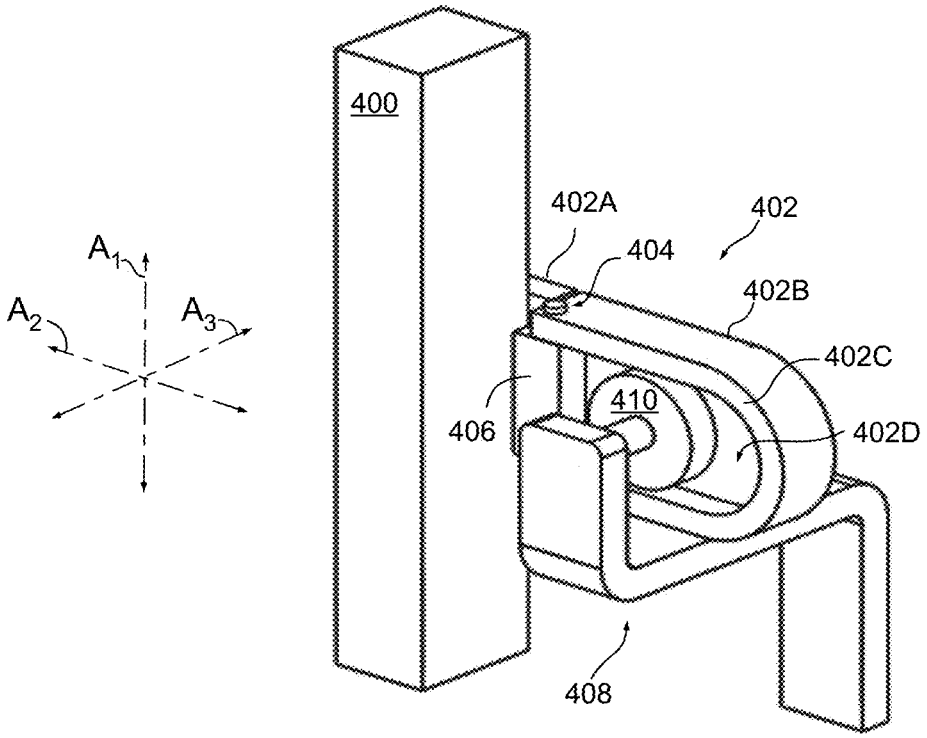
FIG. 4A illustrates an example multi-axial catch mounted on a frame and in an at-rest position, according to aspects of the disclosure.
Figure 4B:
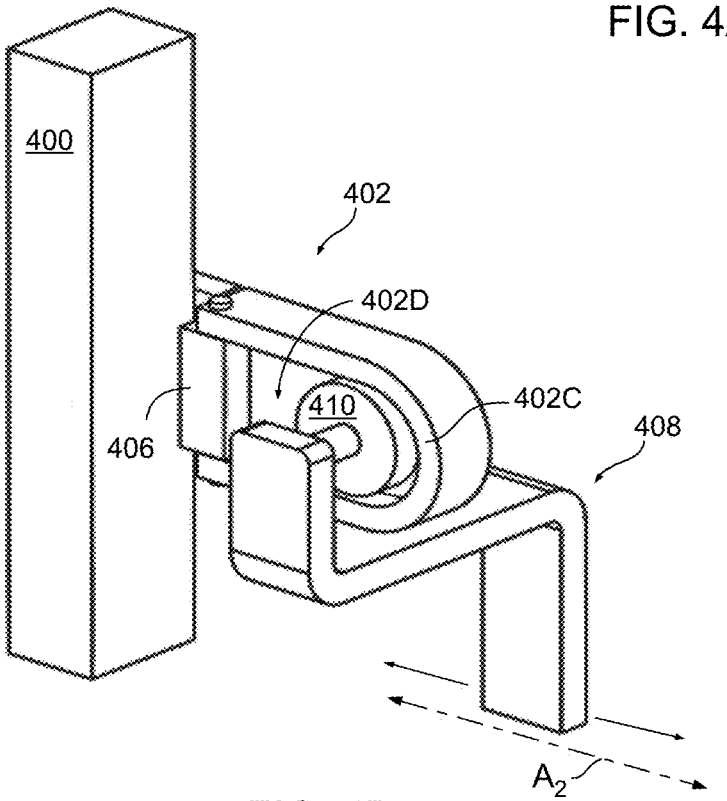
FIG. 4B illustrates the example multi-axial catch of 4A positioned in response to a sideways motion of a latch, according to aspects of the disclosure.
Figure 4C:
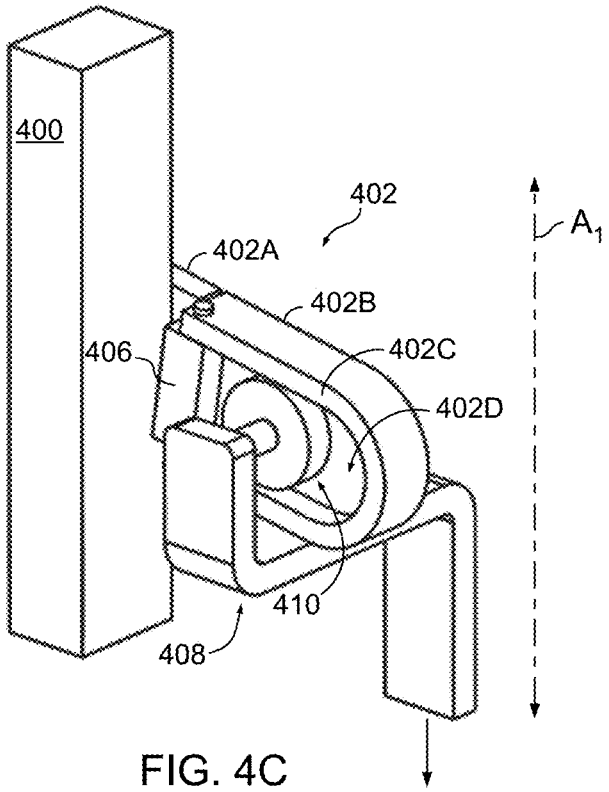
FIG. 4C illustrates the example multi-axial catch of 4A positioned in response to a downward motion of a latch, according to aspects of the disclosure.
Figure 4D:
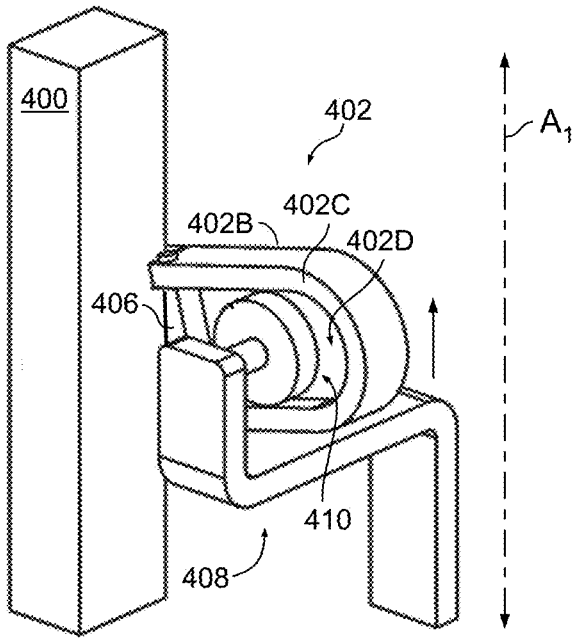
FIG. 4D illustrates the example multi-axial catch of 4A positioned in response to an upward motion of a latch, according to aspects of the disclosure.
Figure 4E:
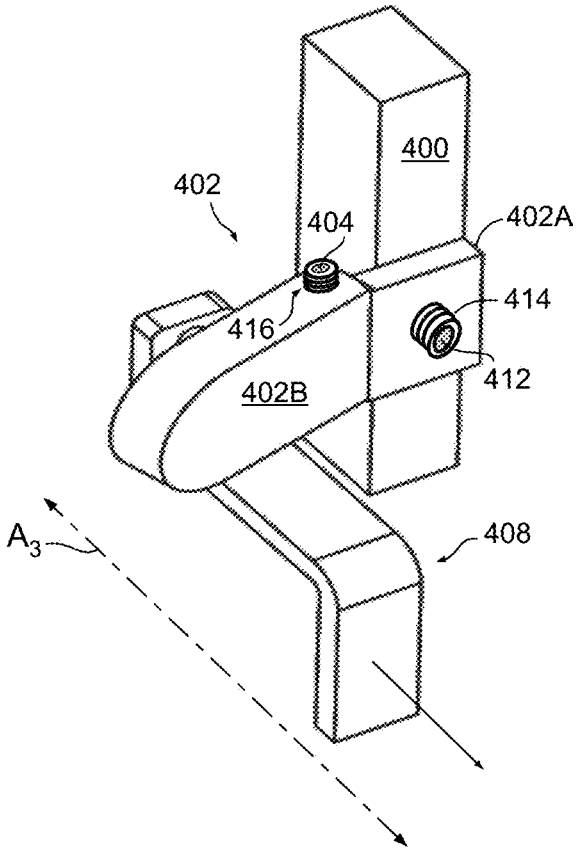
FIG. 4E illustrates the example multi-axial catch of 4A positioned in response to an outward motion of a latch, according to aspects of the disclosure.
Figure 4F:
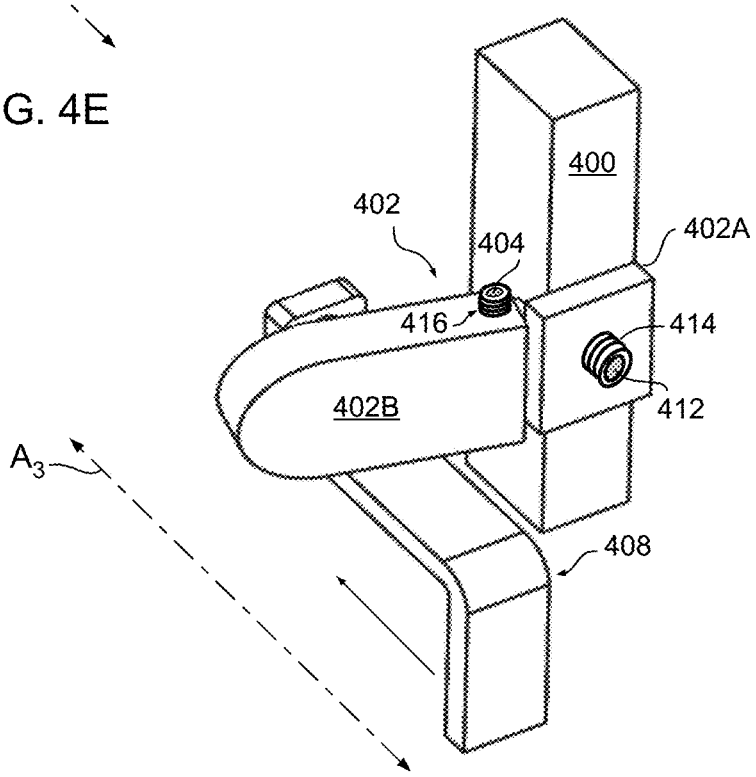
FIG. 4F illustrates the example multi-axial catch of 4A positioned in response to an inward motion of a latch, according to aspects of the disclosure.

As will be seen in discussion of FIGS. 4E and 4F, rotation of a catch body of a multi-axial catch, around a pivot axis, can facilitate the catch maintaining closure of a door in response to transverse motions of the door.

In embodiments, link plate 324 can be, for example, a molded (e.g., cast) member of mount plate 334; can be a plate welded, or otherwise bonded, to mount plate 320; or, can be a plate bolted to mount plate 320. Pivot pin 334 can be, for example, a pin or a bolt. and can be secured to catch body 330 by means of, for example, a nut or a retaining ring (not shown in FIG. 3A). In embodiments, a pivot pin need not necessarily be a pin to pass through a link plate (or, other structure of a mount) and catch body. For example, in an alternative embodiment, pivot pin 334 can be a cast element of link plate 324, with a top and bottom projection to couple to a respective top and bottom hole of catch body 330. In another example, a link plate (such as 324), can comprise a top and a bottom cavity and a respective top and a bottom pivot pin passing through or, integrated into, a catch body (such as 330) can mate with the respective top and bottom cavities of the link plate. Thus, it would be apparent to one of ordinary skill in the art that a variety of mechanical alternatives can serve to couple a catch body and a mount (e.g., a link plate of a mount) in a manner that facilitates rotation of the catch body around a pivot axis.

FIG. 3A also depicts pivot spring 336 passing through catch body 330 and link plate 324. As will be seen in subsequent discussion of an "at-rest" position of catch 310, a spring, such a pivot spring 336, can operate to rotate catch body 330 around pivot pin 334. In embodiments, pivot spring 336 can be coupled to both of link plate 324 and catch body 330. However, pivot spring need not comprise a single spring member passing through link plate 324. For example, while not shown in FIG. 3A, in an embodiment pivot spring 336 can comprise two springs, one coupled to link plate 324 and catch body 330, around pivot pin 334, at the top of catch 310, and a second spring coupled to link plate 324 and catch body 330, around pivot pin 334, at the bottom of catch 310.

FIG. 3A further depicts catch body 330 comprising cam 332 to form recess 312. FIG. 3A further shows example latch head 338 positioned within recess 312 of catch body 330 to engage catch 310 with latch head 338. Latch head 338 can be a component of a latch coupled to a door and latch head 338 positioned within recess 312 can engage the latch with catch 310 to secure the door in a closed position. In embodiments, a recess of a multi-axial catch body can allow lateral movement (along axis $A_2$ in FIG. 3A) of a door without disengaging a latch of the door from the catch.

For example, as previously described with respect to the catch plates of FIGS. 1B and 2A-2D, contact of a latch head with a catch plate is based on maintaining contact between a latch head and the catch plate. Lateral (as well as longitudinal) movement of a door can disengage the latch from the catch if the movement exceeds the horizontal (or, vertical) dimensions of the catch plate, such that the latch (or, a latch head of a latch) slips off the catch plate and allows the door to open. However, a cam and recess, such as illustrated by the example catch body of FIG. 3A, can prevent such slippage, as the cam secures the latch head within the recess as the door moves laterally (e.g., horizontally relative to a cabinet) or longitudinally. (e.g., vertically relative to a cabinet). While not shown in FIG. 3A, in an embodiment recess 312 can have a height (in the direction of longitudinal axis $A_1$) greater than a diameter of latch head 312, for example, and latch head 312 can then move longitudinally (i.e., up and down, in the direction of longitudinal axis $A_1$) within recess 312.

FIG. 3B illustrates an isometric front view of multi-axial catch 310 of FIG. 3A, such as can be observed looking from the exterior of a cabinet at catch 310 mounted on a frame of the cabinet. In FIG. 3B cam 332, recess 312, link plate 324, pivot spring 336, and pivot pin 334 passing through link plate 324 are indicated by hidden lines. While not necessarily required in an embodiment, as can be seen in both FIGS. 3A and 3B a gap, "G", between mount plate 320 and catch body 330 can facilitate rotation of catch body 330 around pivot pin 334 (e.g., in response to transverse movement of a door secured by catch 310).

Thus, a rotation axis of a multi-axial catch can comprise a transverse axis of a mount of the catch (e.g., a transverse axis of mount plate 320). To illustrate, in FIG. 3B transverse axis TR is shown to be a transverse axis of mount pin 326. Axis TR can be a rotation axis of catch 310, and longitudinal motions (e.g., upward and downward) of a door, having a latch coupled to latch head 338, can cause latch head 338 to press, respectively, on the upper and lower edges of cam 332. In response, catch 310 can rotate around axis TR, which can relieve forces of the door on the latch and catch 310 and maintain engagement of latch head 338 with catch body 330.

In a multi-axial catch such as the example of catch 310 in FIGS. 3A and 3B, a catch body, such as 320, can be coupled to a mount such that the catch body can rotate around a pivot axis, such as a longitudinal axis of the mount at the point the catch body is coupled to the mount. In FIGS. 3A and 3B, catch body 330 is shown coupled to mount plate 320 by pivot pin 334. As shown in FIG. 3B, longitudinal axis LO through pivot pin 334 can be a pivot axis around which catch body 330 can rotate, such as in response to inward and outward motions of a door having a latch coupled to latch head 338 with latch head 338 coupled with catch body 330. Rotation of catch body 330 around a pivot axis, such as axis LO in FIG. 3B, can relieve transverse (e.g., inward and outward) forces of the door on the latch and catch 310 and maintain engagement of latch head 338 with catch body 330.

A multi-axial catch can have an "at-rest" position, which can comprise a position of a catch, as a whole, and/or a position of components of a catch, with the catch affixed to a frame and not subject to motions and/or forces of a closed door. In embodiments, an at-rest position of a multi-axial catch can comprise, for example, a "rotational at-rest position" of the catch as a whole, and/or a "transverse at-rest position" of a catch body of the catch. For brevity, an "at-rest position of a catch" refers hereinafter to a rotational at-rest position of the catch, as a whole. An "at-rest position of a catch body" refers hereinafter to a transverse at-rest position of the catch body. In FIGS. 3A and 3B catch 310 and catch body 330 are shown in such rotational and transverse at-rest positions, relative to catch 310 fixed to a frame roughly perpendicular to the frame (e.g., with pivot pin 334 roughly parallel to a longitudinal axis of the frame).

A rotational at-rest position of a catch can comprise a position of a catch relative to, for example, a lateral axis (e.g., axis LA in FIG. 3B) of the mount, which can be an "un-rotated" position of catch 310 relative to rotation around a rotation axis of the catch, such as axis TR in FIG. 3B. For example, with reference to FIG. 3B, catch 310 mounted to a frame of a cabinet, with axis LA perpendicular to a longitudinal axis of the frame, can have a rotational at-rest position that aligns the catch as a whole parallel to a lateral axis such as axis LA. When not subject to motions of a closed door in a longitudinal direction (e.g., motions of the door upward or downward relative to a cabinet), catch 310 can be in this rotational at-rest position.

A transverse at-rest position of a catch body can comprise a position of a catch body when the catch, as affixed to a frame, is not subject to transverse forces (e.g., resulting from inward and outward motions) of a door. For example, in FIG. 3A a transverse at-rest position of catch body 330 can comprise catch body 330 lying within plane P, which can be an "un-rotated" position of catch body 330 relative to rotation around a pivot axis of the catch body, such as axis LO in FIG. 3B. When not subject to motions of a closed door in a transverse direction (e.g., motions of the door inward or outward relative to a cabinet), catch body 330 can be in this transverse at-rest position.

In embodiments a multi-axial catch, and/or catch body, can rotate away from such an at-rest position in response to longitudinal (e.g., upward or downward) and/or transverse (e.g., inward or outward) motions of a closed door. Accordingly, a multi-axial catch can include an "elastic coupler" coupled to a mount and/or coupled to a catch body. An elastic coupler coupled to a mount can operate to oppose and absorb longitudinal forces on the catch. The elastic coupler operating to absorb longitudinal forces on the catch can in turn relieve some or all of these forces on the catch, a latch engaged with the catch, a frame to which the catch is fixed, and/or the door itself. Additionally or, alternatively, an elastic coupler coupled to a mount can operate to return the catch, as a whole, to a rotational at-rest position of the catch in the absence of such longitudinal forces.

Similarly, an elastic coupler coupled to a pivot point of a catch body can operate to oppose and absorb transverse forces on the catch. The elastic coupler operating to absorb transverse forces on the catch can in turn relieve some or all of these forces on the catch, a latch engaged with the catch, a frame to which the catch is fixed, and/or the door itself. Additionally or, alternatively, an elastic coupler coupled to a catch body can operate to return the catch body to a transverse at-rest position of the catch body in the absence of such longitudinal transverse forces.

As used hereinafter, but not intended to limit embodiments, "mount spring" refers to an elastic coupler coupled to a mount of a multi-axial catch, and "pivot spring" refers to elastic coupler coupled to a catch body of a multi-axial catch. In embodiments, a mount spring can be, for example, a torsion spring coupling a mount plate and a mount pin and/or coupling a mount plate to a frame. If the mount pin is fixed to the frame such that the mount pin does not itself rotate, rotating the mount plate around a rotation axis of the mount pin (e.g., in response to a longitudinal force of a latch head on the catch), away from a rotational at-rest position of the catch, can place a torsional force on the spring. In response, the spring can act to absorb the longitudinal force on the catch and/or to return the mount plate to the rotational at-rest position of the catch.

Similarly, a pivot spring can be, for example, a torsion spring coupling a catch body and a pivot pin or, alternatively coupling a catch body and a mount (e.g., coupling a catch body and a link plate of a mount plate). Rotating the catch body around a pivot axis of the pivot pin (e.g., in response to a transverse force of a latch on the catch), away from a transverse at-rest position of the catch body, can place a torsional force on the spring. In response, the spring can act to absorb the transverse force on the catch body and/or to return the catch body to the at-rest position of the catch body.

Thus, in FIGS. 3A and 3B, catch 310 is shown including mount spring 328 and pivot spring 336. In FIGS. 3A and 3B, mount spring 328 is shown surrounding mount pin 326. In embodiments, mount spring 328 can be coupled to mount plate 320 to provide a fixture for mount spring 328 to oppose a torsional force on mount spring 328 resulting from rotation of mount plate 320 around a rotation axis, such as axis TR in FIG. 3B. Thus, mount spring 328 can oppose (and, absorb) a longitudinal force on catch 310 and, in the absence of such longitudinal forces (e.g., in the absence of motions of a door upward and downward), mount spring 328 can return catch 310 to a rotational at-rest position of catch 310, such as shown in FIGS. 3A and 3B.

Similarly, pivot spring 336 is shown in FIGS. 3A and 3B surrounding pivot pin 334. In embodiments, pivot spring 336 can couple catch body 330 to link plate 324 (or, alternatively, to pivot pin 334) and link plate 324 can provide a fixture for a pivot spring 336 to oppose a torsional force of pivot spring 336 resulting from rotation of catch body 330 around a pivot axis, such as axis LO in FIG. 3B. Thus, pivot spring 336 can oppose (and, absorb) a transverse force on catch body 330 around axis LO and, in the absence of such transverse forces (e.g., in the absence of motions of a door inward and outward) pivot spring 336 can return catch body 330 to a transverse at-rest position of catch body 330, such as shown in FIGS. 3A and 3B.

However, these examples are not intended to limit embodiments. It would be apparent to one of ordinary skill in the art that a variety of elastic elements or devices, in various configurations and methods of coupling, can oppose rotation of a multi-axial catch (e.g., rotation of a mount of the catch) around a rotation axis and/or can oppose rotation of a catch body of a multi-axial catch around a pivot axis (e.g., rotation of a catch body around a pivot axis of the catch). Similarly, it would be apparent to one of ordinary skill in the art that a variety of elastic elements or devices, in various configurations and methods of coupling, can operate to return a multi-axial catch to a rotational at-rest position, and/or to return a catch body of a multi-axial catch to a transverse at-rest position. For example, in embodiments a top spring, coupling the top of a mount plate to a frame, and a bottom spring, coupling the bottom of the mount plate to the frame, can oppose rotation of a catch around a rotation axis and can return the catch to its at-rest position. Such a top spring can oppose downward rotation of the catch around a rotation axis, and the bottom spring can opposed upward rotation of the spring. In another example, an elastic band or plate can operate as an alternative elastic coupler to a spring.

Similarly, a catch body can be coupled to a mount plate by, for example, an elastic plate or band, and the elastic plate or band can oppose inward and/or outward rotation around a pivot pin, and can return the catch body to its at-rest position. A pivot pin can be, for example, a hinge pin of a hinge coupling a catch body to a mount plate, with the hinge pin oriented along a pivot axis of the catch. The pivot spring can be coupled to one or both halves of the hinge and/or to one or both of the catch body and mount plate and can oppose transverse forces on the catch body and/or return the catch body to a transverse at-rest position.

FIGS. 4A-4F illustrate an example embodiment of a multi-axial catch in an example at-rest position and in response to example motions of a door having a latch engaged with the catch. In embodiments example multi-axial catch 402 (hereinafter, "catch 402") of FIGS. 4A-4F can be a catch similar to catch 310, of FIGS. 3A and 3B. To illustrate the examples, but not intended to limit embodiments, in FIGS. 4A-4F catch 402 is shown fixed to frame 400. In embodiments frame 400 can be, for example, a frame of a cabinet, similar to frame 104A or 104B of cabinet 100 in FIG. 1A. Latch 408 can be a latch, similar to latch 206, of FIGS. 2A and 2B, or 224 of FIGS. 2C and 2C, coupled to a door of the cabinet to engage catch 402. Thus, in the descriptions of FIGS. 4A-4F to follow, references to "the door" refer to a door coupled to latch 408, and references to "the closed door" refer to the door in a closed position with latch 408 engaged with catch 402 to secure the door in the closed position. In embodiments, latch 408 can be coupled to the door to pivot or rotate, for example, such as in the examples of FIGS. 2A-2D. Latch head 410 of latch 408 can be positioned within recess 402D to engage catch 402, such as depicted in FIG. 4A, to secure the door in the closed position.

To provide a frame of reference for the discussion of FIGS. 4A-4F, FIG. 4A also depicts axes $A_1$, $A_2$, and $A_3$ of FIG. 3A, which can correspond, respectively, to longitudinal, lateral, and transverse axes of frame 400 and catch 402. Accordingly, in the discussion of FIGS. 4A-4F to follow, references to "upward" and "downward" are understood to be generally in the direction of longitudinal axis $A_1$, references to "sideways" are understood to be generally in the direction of lateral axis $A_2$, and reference to "inward" and "outward" are understood to be generally in the direction of transverse axis $A_3$.

While FIGS. 4A-4F depict example catch 402 mounted on, and generally perpendicular to, a rectangular frame, in embodiments a frame need not have a rectilinear cross-section (such as shown in FIGS. 4A-4F), a multi-axial catch need not necessarily be mounted to a straight segment of a frame, and a multi-axial catch need not necessarily be limited to a perpendicular orientation relative to the frame. For example, a frame can have a circular or oval cross-section, and/or a curved shape. A multi-axial catch can be mounted at an intersection of segments, or members, of a frame, such as at an, and/or can have a cross section geometry other than rectangular (e.g., a frame can have a circular, oval, or other rectilinear cross section). A multi-axial catch can be fixed to a frame at an acute intersection of rectilinear segments of a frame. Thus, it would be apparent to one of ordinary skill in the art that a frame to which a catch is mounted, and/or the orientation of the mounting of the catch, is not limited to the example of FIGS. 4A-4F, and that a multi-axial catch can be fixed to any variety of frames (or, alterative structures that secure closure of a door) in any variety of orientations such as necessary to facilitate operations of the catch to secure closure of a door in response to motions of the door along longitudinal, lateral, and/or transverse axes.

Turning, now, more particularly to FIG. 4A, as previously described catch 402 can be a catch similar to catch 310, of FIGS. 3A and 3B and, accordingly, FIG. 4A further illustrates catch 402 comprising mount plate 402A, catch body 402B, and cam 402C forming recess 402D in catch body 402B. In FIG. 4A, catch 402 is shown further including link plate 406 and pivot pin 404, which can be similar, respectively, to link plate 324 and pivot pin 334 of FIGS. 3A and 3B, to couple catch body 402B to mount plate 402A. As previously described in reference to FIG. 3B, a multi-axial catch as whole, and a catch body of a multi-axial catch, can have an at-rest position in the absence of motions of a door on the catch. FIG. 4A illustrates latch 408 engaged with catch 402, by means of latch head 410 positioned within recess 402D, and with catch 410 in a rotational at-rest position and catch body 402B in a transverse at-rest position.

While not visible in FIGS. 4A-4D, catch 402 can be coupled to frame 400 via a mount pin and a mount spring, visible in FIGS. 4E and 4F as mount pin 412 and mount spring 414, respectively. In an embodiment mount pin 412 can be similar to mount pin 326 of FIGS. 3A and 3B, and mount spring 414 can be similar to mount spring 328 of FIGS. 3A and 3B. As described in reference to catch 310 in FIGS. 3A and 3B, such mount pin 412 can affix catch 402 to frame 400, and catch 402 can rotate, as a whole, around mount pin, on frame 400, in response to upward and downward motions of the closed door. Also similar to mount spring 328, mount spring 414 can oppose upward and downward forces on catch 402 and/or to return catch 402 to this rotational at-rest position.

Additionally or, alternatively, while also not visible in FIGS. 4A-4D, catch 402 can include a pivot spring, visible in FIGS. 4E and 4F as pivot spring 416. In embodiments pivot spring 416 can be coupled to pivot pin 404, mount plate 402A, and/or catch body 402B, similar to pivot spring 336 of FIGS. 3A and 3B. Such a pivot spring can operate similarly to pivot spring 336, to oppose inward and outward forces on catch body 402B, and/or to return catch body 402B to this transverse at-rest position.

FIGS. 4B-4F, then, further illustrate various positions and operations of catch 402 in response to sideways, upward/downward, and inward/outward motions of the closed door and corresponding forces on catch 402. Turning first to FIG. 4B, with latch head 410 positioned within recess 402D of catch body 402B a sideways motion of the closed door (e.g., in the direction of lateral axis $A_2$ in FIG. 4B) can cause latch head 410 to exert a corresponding lateral force on link plate 406 and/or cam 402C of catch body 402. For example, in response to a sideways motion of a closed door away from frame 400, latch head 410 can exert a lateral force on the curved end of cam 402C. Similarly, in response to a sideways motion of a closed door toward frame 400, latch head 410 can exert a lateral force on link plate 406 and/or cam 402C.

Cam 402C and link plate 406 can oppose these lateral forces, which can relieve some or all of the lateral force of the door's motion on latch 408 and/or catch 402. Further, cam 402C can operate to retain the position of latch head 410 within recess 402D to maintain closure of the door during these sideways motions. In the absence (or, upon cessation) of such sideways motions of the door, latch head 410 can return to a position within catch body 402B corresponding to a lateral position of the closed door not undergoing sideways motion, such as the at-rest position of latch head 410 and catch 402 shown in FIG. 4A.

FIGS. 4C and 4D depict positions of catch 402 in response to upward and/or downward motions of the closed door (e.g., in the general direction of axis $A_1$ in FIGS. 4C and 4D). FIG. 4C depicts catch 402 positioned downward as a result of a downward motion of a closed door. The downward motion of the door can produce a corresponding downward force of latch head 410 on cam 402C, which can in turn cause catch 402 to rotate downward (e.g., clockwise as viewed in FIG. 4D towards recess 402D) around a rotation axis centered on mount pin 412. FIG. 4D depicts catch 402 positioned upward as a result of an upward motion of the closed door. The upward motion of the door can produce a corresponding upward force of latch head 410 on cam 402C, which can in turn cause catch 402 to rotate upward (e.g., counterclockwise as viewed in FIG. 4D towards recess 402D) around a rotation axis centered on mount pin 412.

The rotation of catch 402 around mount pin 412, and/or the opposition of mount spring 414 to these forces, can relieve some or all of the upward and/or downward forces of the door on latch 408 and/or catch 402, or components of these. Additionally or, alternatively, the rotation of catch 402 around mount pin 412 can serve to retain latch head 410 positioned within recess 402D to maintain engagement of latch 408 with catch 402 during the downward or upward motions of the closed door. Mount spring 414 can further act to return catch 402 to the rotational at-rest position of catch 402 shown in FIG. 4A, during (or, upon, cessation of) the upward and downward motions of the closed door.

Finally, FIGS. 4E and 4F depict positions of catch 402 in response to motions of a closed door inward or outward, respectively (e.g., in the general direction of transverse axis $A_3$ in FIGS. 4E and 4F). As previously described, catch body 402B can rotate around a pivot axis of pivot pin 404, such as in response to transverse forces on catch body 402B that can result, for example, from inward and/or outward motions of a closed door. Pivot spring 416 can oppose such transverse forces on catch body 402B and/or can operate to return catch body 402B, in the absence of such transverse forces, to the transverse at-rest position of catch body 402B illustrated in FIG. 4A.

FIG. 4E depicts catch 402 positioned outward as a result of an outward motion of the closed door. As a result of such an outward motion of the closed door, latch 408 can produce a corresponding outward force on catch body 402B by latch head 410 (not visible in FIG. 4E) pressing on recess 402D (also not visible in FIG. 4E) of catch body 402B. The outward force of latch 408 on catch body 402B can correspondingly rotate catch body 402B outward, around pivot pin 404. Pivot spring 416 can oppose such outward force on catch body 402B, and can relieve some or all of the force of the closed door on latch 408 and/or catch body 330. Pivot spring 416 can additionally or, alternatively, operate to return catch body 402B, in the absence of such an outward force, to the transverse at-rest position of catch body 402B such as illustrated in FIG. 4A. Cam 402C can operate, during an outward motion of the closed door, to retain latch head 410 positioned within recess 408D, to maintain engagement of latch 408 with catch 402, and secure the door in its closed position during an outward motion of the door.

An inward motion of the closed door can, potentially, withdraw latch head 410 from recess 402D of catch body 402B, which may, in turn, disengage latch 408 from catch 402 to allow the door to open. However, pivot spring 416 can be configured, in embodiments, to press catch body 402B against latch head 410 in response to an inward motion of the closed door. Thus, FIG. 4F depicts catch 402 positioned inward as a result of an inward motion of the closed door. A transverse at-rest position of catch body 402B can comprise pivot spring 416 pressing against latch head 410 when latch 408 is engaged with catch 402 to close a door.

An inward motion of the closed door can retract latch 408 (inward as well) so as to relieve pressure applied by latch 408 to catch body 402B in the transverse at-rest position of catch body 402B. In the absence of such pressure applied by latch 408 to catch 330, pivot spring 416 can rotate catch body 402B inward around a pivot axis of pivot pin 404, and can thereby act to press catch body 330 inward. Pivot pin 404 rotating catch body 330 inward in this manner can maintain the position of latch head 410 within recess 402D to secure the door in its closed position during an outward motion of the door. Upon cessation of the inward motion of the closed door, the door can return to a previous position corresponding to a transverse at-rest position of catch body 330.

While the descriptions of the examples of FIGS. 4A-4F are with respect to motions of a closed door in the directions of longitudinal, lateral, and transverse axes (e.g., $A_1$,$A_2$, or $A_3$ of the examples of the disclosure), this is not intended to limit embodiments. It would be apparent to one of ordinary skill in the art that a motion of a closed door and, correspondingly, forces of a latch of the door on a multi-axial catch, can be in any direction within the spatial combination of these axes. A multi-axial catch can maintain engagement with a latch of the door—and, thereby, maintain secure closure of the door—during such a motion (or, motions) in any such combination of these directions. For example, the motion of a closed door (and, a corresponding force of a latch on a multi-axial catch) can be a vector result of motions (and, corresponding forces) along any of combination of these 3 axes. Owing to the cam and recess of the catch body, the ability of the multi-axial catch to rotate around a rotation axis of a mount pin, and the ability of the multi-axial catch to rotate inward and outward around a pivot axis of a pivot pin, the multi-axial catch can maintain engagement of a latch throughout these combined motions of a closed door.

The foregoing examples of FIGS. 3A, 3B, and 4A-4F illustrate example embodiments and operations thereof to secure closure of a door. However, such examples are not intended to limit embodiments. For example, a recess of a catch body need not be oval shaped and can be rounded, multi-angular, or any geometry suitable to engage, and retain, latch head having any particular geometry. While the examples of the disclosure illustrate a recess of a catch body having a flat surface, in alternative embodiments a recess of a catch body can be, or can have, a concave region (such as may serve to better engage a spherical, or rounded, latch head).

Similarly, in embodiments the dimensions of a recess of a catch body (or, the dimensions of a cam of the catch body that creates the recess) can vary relative to the dimensions of a latch head. For example, a cam of a catch body can have an internal "wall depth" (e.g., a depth, within the catch body, of the cam that forms a wall of the recess within the catch body) greater than a thickness of a latch head (e.g., the thickness of a disk-shaped latch head), or greater than the radius or diameter of a spherical latch head. Alternatively, a cam of a catch body can have a wall depth equal to or less than a thickness, radius, or diameter of a latch head. A recess of a catch body can have a depth greater than or, alternatively, equal to or less than, the thickness, radius, or diameter of a latch head. A recess can have a length or width greater than a length or width (or, a spherical diameter) of a latch head, or can a length or width only sufficiently greater than a length or width (or, a spherical diameter) of a latch head to facilitate positioning the latch head within the recess.

As previously described, in embodiments a mount plate and a catch body can be coupled, for example, by a hinge, as opposed to a link plate and a pivot pin inserted through the catch body and link plate illustrated in the examples of FIGS. 3A, 3B, and 4A-4F. The catch body can rotate around a hinge pin of the hinge, and/or the hinge can include a spring, or other means (e.g., an elastic plate or band), to oppose inward and outward forces of the catch body around the a pivot axis of the hinge.

Additionally, while the examples of the disclosure illustrate embodiments using the example of a cabinet and a door of the cabinet, this is also not to limit embodiments. For example, as previously described, in embodiments a door can comprise a door of a building; a frame can comprise a frame of a doorway of the building; a multi-axial catch, as disclosed herein, can be affixed to the frame of the doorway; and, a latch of the door can engage the catch to secure the door in a closed position against the frame of the doorway. Similarly, an embodiment can include a drawer, such as a drawer of a desk or cabinet; a frame can comprise a frame or surface of the desk or cabinet; a multi-axial catch, as disclosed herein, can be affixed to the frame; and, a latch of the drawer can engage the catch to secure the drawer in a closed position. Similarly, a multi-axial catch need not necessarily be affixed to a frame and a latch coupled to a door; in embodiments a multi-axial catch can, alternatively, be fixed, or otherwise coupled, to a door and a latch can be fixed, or otherwise coupled, to a frame.

Further, while the examples of FIGS. 3A, 3B, and 4A-4D illustrate a multi-axial catch that can rotate around a rotation axis, and/or that includes a catch body that can rotate around a pivot axis, this is also not intended to limit embodiments. For example, in FIGS. 3A and 3B mount plate 320 and catch body 330 need not necessarily be two elements, nor need not necessarily be coupled at a pivot axis, as shown in FIGS. 3A and 3B. Alternatively, a multi-axial catch can comprise a mount and catch body formed as a single element, or formed without a pivot pin or other coupling. Such a multi-axial catch can be configured to rotate around, for example, a rotation axis of a mount pin, such as illustrated in FIGS. 4C and 4D, but may not be configured to rotate inward and outward around a pivot axis, such as illustrated in the examples of FIGS. 4E and 4F.

Similarly, a multi-axial catch can comprise a catch body that couples to a mount (or, a mount plate) and can rotate around a pivot axis of the catch body and/or mount, such as catch body 330 configured to rotate around pivot axis LO in FIG. 3B. But, such a catch need not necessarily include a mount pin, and/or need not necessarily be configured to rotate the catch around a rotation axis of a mount or mount pin. Thus, such a multi-axial catch can be configured to rotate around a pivot axis of a pivot pin, such as illustrated in FIGS. 4E and 4F, but may not be configured to rotate around a rotation axis of the mount, such as illustrated in the examples of FIGS. 4C and 4D.

Thus. the descriptions of the various embodiments of the present disclosure have been presented for purposes of illustration, but are not intended to be exhaustive or limited to the embodiments disclosed. Many additional and alternative modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A multi-axial catch, the catch comprising:

a mount configured to affix the catch to a frame; and, a catch body coupled to the mount, wherein the catch body comprises a recess configured to position a latch head of a latch within the recess to engage the latch with the catch;

wherein the mount is configured to allow the catch to rotate, in response to a longitudinal motion of the latch, around a rotation axis;

wherein a position of the catch comprises a rotational at-rest position of the catch and the catch further comprises a first elastic coupler configured to position the catch in the rotational at-rest position;

wherein the catch body coupled to the mount comprises the catch body coupled to the mount by means of a pivot pin to allow the catch body to rotate, in response to a transverse motion of the latch, around a pivot axis;

wherein the pivot axis corresponds to a longitudinal axis of the pivot pin;

wherein a position of the catch body comprises a transverse at-rest position of the catch body around the pivot axis and the catch further comprises a second elastic coupler configured to position the catch body in the transverse at-rest position; and wherein the second elastic coupler is further configured to couple the catch body to at least one of the mount and the pivot pin to position the catch body in the transverse at-rest position.

2. The multi-axial catch of claim 1, wherein the latch is coupled to a door; and, wherein the latch engaged with the catch operates to secure close the door in a closed position of the door.

3. The multi-axial catch of claim 1, wherein the catch body further comprises a cam that forms the recess; and, wherein the cam forms the recess to have a geometry of the recess that permits the latch head to move laterally, within the recess, in response to a lateral motion of the latch.

4. The multi-axial catch of claim 3, wherein the mount comprises a mount pin to affix the catch to the frame;

wherein the rotation axis comprises a transverse axis of the mount pin; and, wherein the first elastic coupler is further configured to couple the mount to at least one of the frame and the mount pin to position the multi-axial catch in the rotational at-rest position.

5. The multi-axial catch of claim 4, wherein the mount comprises a link plate; and, wherein the catch body coupled to the mount by the means of the pivot pin comprises the catch body coupled to the mount by the means of the pivot pin coupling the catch body to the link plate.

6. The multi-axial catch of claim 5, wherein at least one of the first and the second elastic coupler is selected from a group comprising: a spring, an elastic plate, and an elastic band.

7. The multi-axial catch of claim 2, wherein the frame is selected from a group consisting of: a frame of a cabinet, a frame of a desk, a frame of a doorway, and a frame of a rack of a computing system; and, wherein the door is selected from a group consisting of: a door of the cabinet, a front panel of a drawer of the desk, a door of the doorway, and a drawer of the rack.

8. The multi-axial catch of claim 1, wherein the first elastic coupler is further configured to couple the mount to the mount pin to position the multi-axial catch in the rotational at-rest position.

9. The multi-axial catch of claim 1, wherein the mount comprises a link plate; and, wherein the catch body coupled to the mount by the pivot pin comprises the catch body coupled to the mount by the pivot pin coupling the catch body to the link plate.

10. The multi-axial catch of claim 1, wherein the second elastic coupler is further configured to couple the catch body to the mount to position the catch body in the transverse at-rest position.

11. The multi-axial catch of claim 1, wherein the second elastic coupler is further configured to couple the catch body to the pivot pin to position the catch body in the transverse at-rest position.

12. The multi-axial catch of claim 1, wherein the second elastic coupler is selected from a group comprising: a spring, an elastic plate, and an elastic band.

* * * * *